US006226949B1

(12) United States Patent
Huber

(10) Patent No.: US 6,226,949 B1
(45) Date of Patent: May 8, 2001

(54) SIMULATED THATCHED ROOF

(76) Inventor: Barry Ray Huber, P.O. Box 1264, Lake City, FL (US) 32056

( * ) Notice: Subject to any disclaimer, the term of this patent is extended or adjusted under 35 U.S.C. 154(b) by 0 days.

(21) Appl. No.: 09/294,222

(22) Filed: Apr. 19, 1999

(51) Int. Cl.[7] ..... E04D 9/00

(52) U.S. Cl. ..... 52/555; 428/17; 428/27; 428/99

(58) Field of Search ..... 428/17, 27, 99; 52/555, 518

(56) References Cited

U.S. PATENT DOCUMENTS 233,269 * 10/1880 McClelland ..... 52/750
614,478 * 11/1898 Johnston ..... 52/555
1,492,610 * 5/1924 Simpson ..... 428/17
5,333,431 * 8/1994 Houpt ..... 52/518

* cited by examiner

*Primary Examiner*—Alexander S. Thomas
(74) *Attorney, Agent, or Firm*—Thomas C. Saitta

(57) ABSTRACT

A novel roofing material simulating natural thatch and methods of applying the roofing material comprises the provision of simulated thatch shingles or rolls of such material. The shingles or rolls are formed of elongate reeds or thatch elements formed of a polymer material and arranged in laterally extending bundles. The thatch elements are folded and secured to a binder and are secured to an appropriate substrate which is secured to the roof. Each shingle or roll extends in overlying relation to produce a shingled arrangement which simulates a natural thatched roof.

18 Claims, 2 Drawing Sheets

SIMULATED THATCHED ROOF

FIELD OF THE INVENTION

This invention relates to roofs and roofing materials, and more particularly to thatched roofs.

BACKGROUND OF THE INVENTION

The style, configuration and color of roofing elements often contribute to the attractiveness of residential houses and buildings of commercial interest. For example, the various thatch roofs of the world, consisting of a multiplicity of natural thatching materials, usually impart a certain aura to the building it has covered. (Just as tile or slate roofs usually impact a regional or ethnic aura.) Although thatch roofs are not uncommon in certain parts of the world, thatched roofs are a relatively rare occurrence in the United States. Natural thatching is uncommon, being often restricted by local building codes, and/or a concern of fire, rot, etc. Additionally, there are few, if any skilled thatchers.

SUMMARY OF THE INVENTION

It is an object of this invention to provide a novel roofing material and to show an associated method of applying the same and thereby simulate natural thatch. The novel roofing material is comprised of "reeds" or thatch elements simulating natural thatch material but preferably formed of a weather resistant, and in some instances fire resistant, polymers. The thatch elements are bound together with a binder and are arranged in sections or shingles. The simulated thatched roofing may also be arranged in rolls of a predetermined length.

DESCRIPTION OF THE PREFERRED EMBODIMENT

Figure 1:
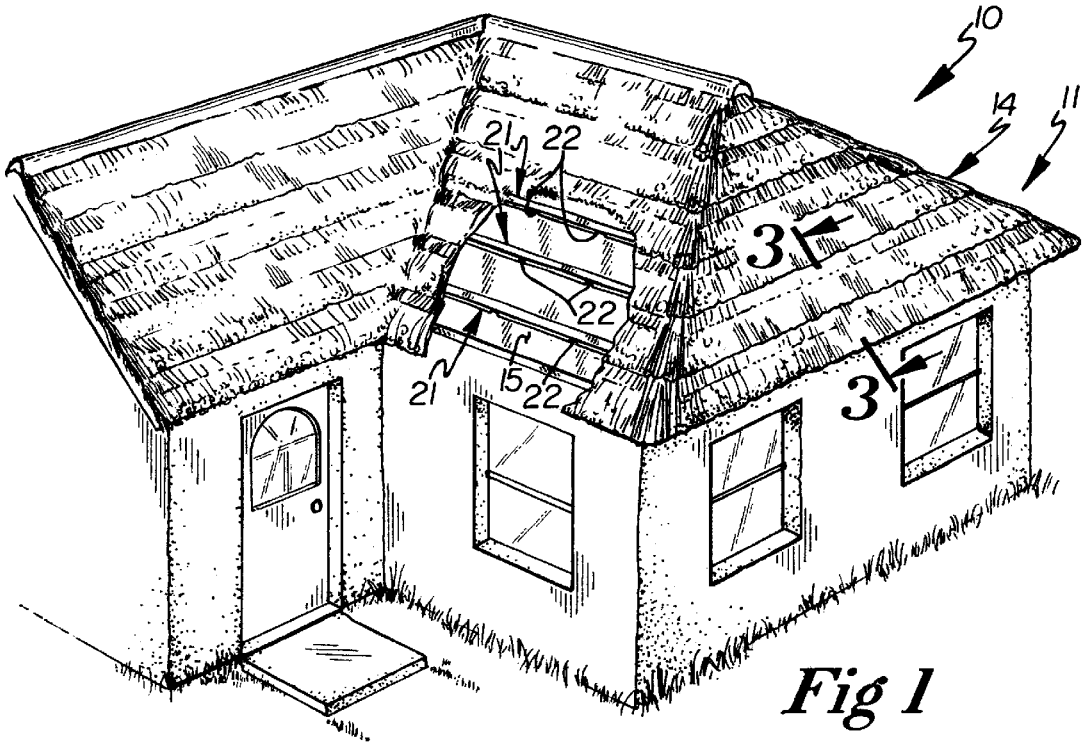
FIG. 1 is a perspective view of a small building having a roof formed of the simulated thatching material with certain parts thereof broken away to illustrate underlying components.

Referring now to FIG. 1, it will be seen that a building 10 having a roof 11 which incorporates the novel thatch roofing

14 is thereshown. The roof 11 is assumed to be of conventional frame wood, steel or other support memebers 12 to support appropriate roof deck, or substrate 13, for fastening of the thatch shingle or thatch roll. A water impervious membrane 15 is applied to the roof substrate 13 to serve as either a primary or a secondary, waterproofing.

Figures 3, 4, 5, 6, 7, 8, 9:
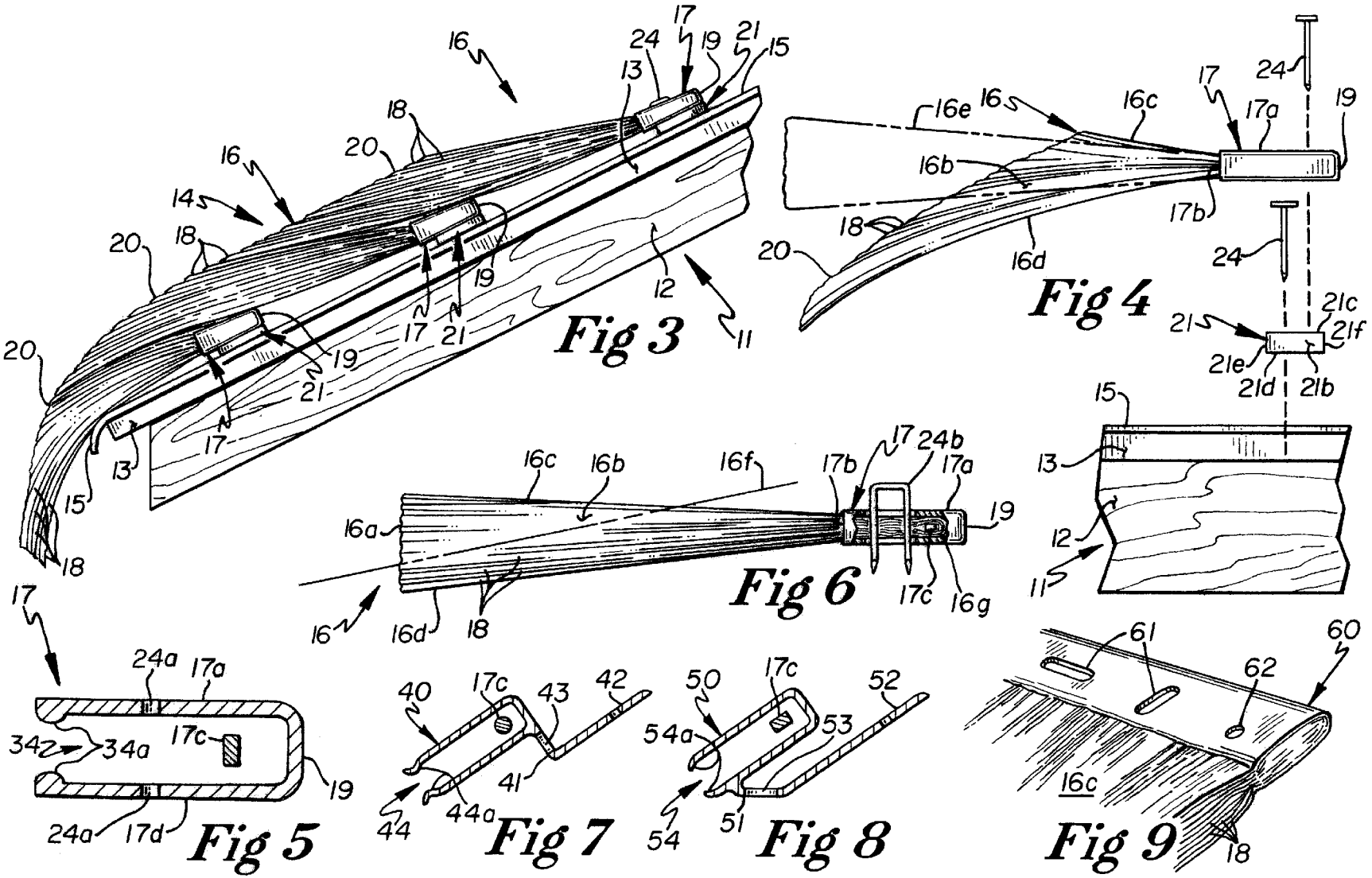
FIG. 3 is a cross sectional view taken approximately along line 3—3 of FIG. 1 and looking in the direction of the arrows.
FIG. 4 is an exploded side view of a thatch shingle and portions of the roof illustrating the manner in which the thatch shingles are attached to the frame, the phantom line configuration illustrating the thatch elements before cutting or as predisposed in offset manner.
FIG. 5 is a cross-sectional view of the binder.
FIG. 6 is a side elevational view of a thatch shingle, and binder, the phantom line illustrating the cut pattern for shaping the shingle.
FIG. 7 is a cross-sectional view illustrating a modification of the binder.
FIG. 8 is a cross-sectional view illustrating another modification of the binder.
FIG. 9 is a fragmentary perspective of different embodiment of a shingle.

The roofing 14 simulates natural thatching and is comprised of roofing shingles 16 or roofing rolls 160. The shingles 16 or rolls 160 are formed of a plurality of plastic or polymer "reeds" or "thatch elements 18" secured together by an elongate binder 17. The reeds 18 are disposed in a substantially parallel relation with each other and are arranged in a laterally extending bundle. The reeds 18 are fixed in a binder 17 as individual reeds or as longer reeds folded approximately 180 degrees in the binder 17. The binder 17 extends transversely of the reeds 18 and is secured to the folded portion of the transversely extending bundle. Each thatch shingle 16 is of a generally rectangular configuration and includes a relatively large number of individual reeds 18 forming a thatch body 16*b*with folded portion 16*g*and unbound free ends 16*a* all extending in the same direction from the binder 17. The thatch shingle 16 also has a upper surface 16*c* and a lower surface 16*d*. Reeds 18 can be folded around a center element 17*c* of wire or other of a variety of materials and thereby locked in an offset pattern to produce the beveled portion 20. The binder 17 may be formed of a suitable plastic polymer or metal binder. The binder 17 may be of a variety of shapes and of binding characteristics. The phantom line configuration 16*e* of FIG. 4 illustrates the configuration of the thatch elements 18 of a shingle 16 before these thatch elements 18 are offset or trimmed to produce the beveled or sloping portion 20, as shown by the phantom line 16*f* of FIG. 6.

The reed or thatch elements 18 are preferably formed of a plastic or polymer of any of various manufacturers, such as, or similar to General Electric Plastics under the trademark GEON. In the embodiment shown in FIGS. 1–6 the reeds 18 are secured to the binder 17 by gluing, heat sealing, sewing. or metal binding and project therefrom. The binder 17 may be of C-shaped configuration as illustrated in FIGS. 1–6 & 9 or may have other shapes. C-shaped binders 15 have a topwall 17*a*, open front 17*b*. bottom wall 17*d*, and a rear wall 19. The presence of rear wall 19 is not essential. The thatch elements 18 extend through open front 17*b* but are looped about a center element 17*c*. If the thatch elements 18 are offset when disposed in the binder 17, the sloping edge is formed by the free end 16 *a*. Otherwise the thatch elements 18 may be trimmed.

The reeds 18 may be weather resistant, and either UV light resistant and/or fire resistant. Since the reeds or thatch elements 18 simulate thatch, the reeds and thatch elements are somewhat flexible.

In the embodiment as shown, the roofing shingles 16 are preferably 36 inches wide and vary in length whether folded bound reeds 18 or singularly bound reeds 18. The reeds project from the lower longitudinal edge of the binder 17 preferably approximately 8 to 12 inches.

Figure 2:
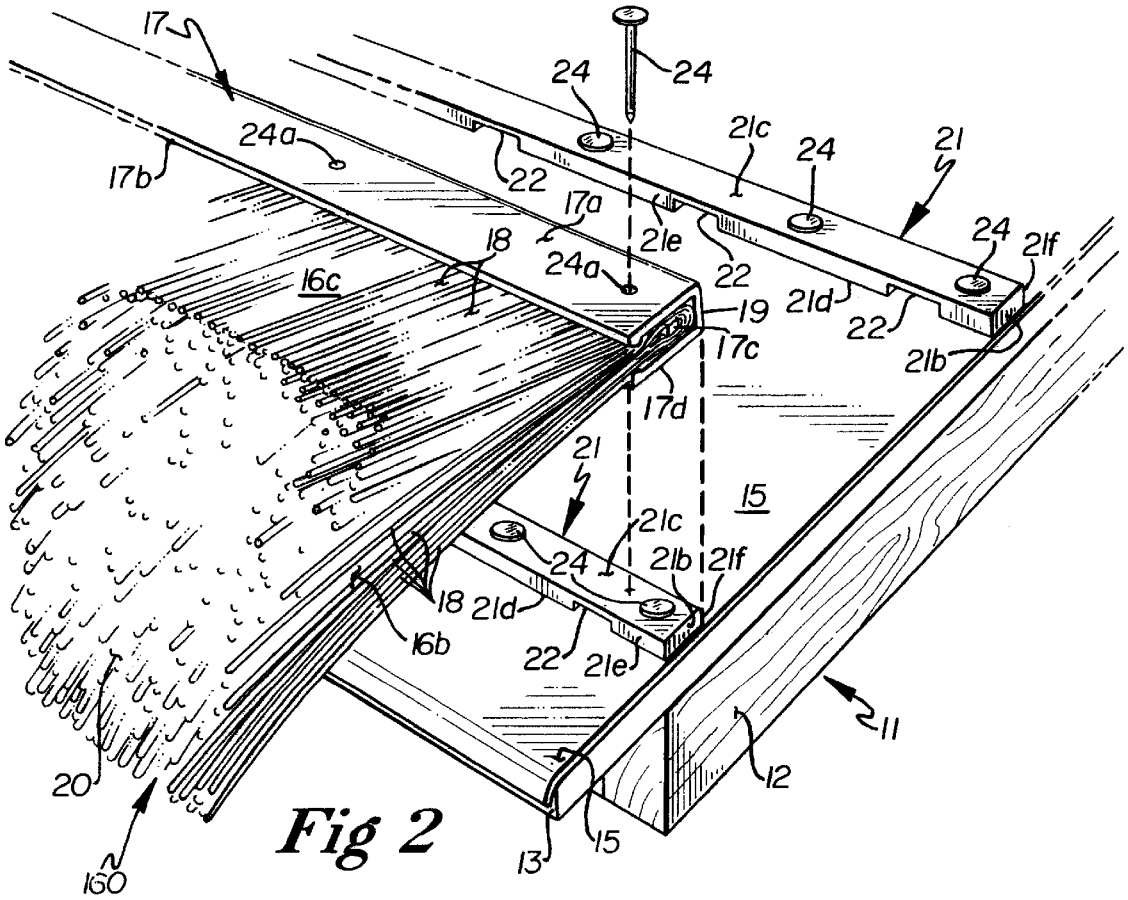
FIG. 2 is a fragmentary exploded perspective view of a portion of a thatch roof and a portion of the underlying roof frame structure illustrating details of construction thereof.

Referring to FIGS. 2–4, it will again be noted that the free ends 16*a* extends downwardly and outwardly to define a sloping or beveled portion 20. In the embodiment shown, the sloping edge portion 20 of the shingles 16 preferably is approximately 5–6 inches in length. The thatched roofing 14 may also be formed in rolls 160, as shown in FIG. 2, of sufficient length to cover a significant length of the roofing boards from hip to the adjacent valley. The rolls 160, when unwound are preferably of elongate rectangular configuration and also have the beveled or sloping portion 20 in the manner of the shingles 16. Various types of fasteners 24 may be used such as nails illustrated in the embodiments of FIGS. 1–5 with fastener apertures 24*a* optionally provided in the binder 17. Staples 24*b* may also be used as shown in FIG. 6.

The thatch shingles 16 or rolls 160 may be applied by a variety of standard practice applications. They may be installed on battens 21 or the binder 17 itself may be installed directly onto the deck 13 to act as a batten to elevate it off the roof deck 13. If a batten 21 is used, it may be elongate, rectangular configuration including end surfaces 21*b*, top surface 21*c*, bottom surface 21*d*, front surface 21*e*, and rear surface 21*f*.

Referring now to FIG. 5, the binder 17 is thereshown in crossection. The binder 17 is of generally simple C-shaped configuration having a rear wall 19, an upper horizontal top wall 17*a* and a lower bottom wall 17*d*, which together define a forwardly opening recess 34 which receives the thatched elements or reeds 18 therein. The recess 34 is bounded at its front end by lips 34*a*. The reeds or thatch elements 18 may be secured in the recess 34 by glue, heat sealing, sewing, metal binding, or similar means. The binder 19 is secured to the associated batten 21 or roof deck 13 by appropriate fasteners 24 in the manner of the embodiment of FIGS. 1 to 4. The thatch elements 18 are looped over a center element 17*c* and are offset or trimmed to present the sloping surface 20.

Referring now to FIG. 7, it will be seen that a different embodiment of the binder designated as element 40 is thereshown. The binder 40 is of generally C-shaped configuration having a forwardly opening recess 44 bounded by inwardly projecting lips 44*a*. The binder 40 has a depending flange 41 which is integral with an attachment portion 42. A drain hole 43 is provided in the depending flange 41.

The attachment portion 42 will be secured to the substrate 13 by suitable fasteners 24 . No batten is required with binder 40. The binder 40 will be provided with a center element 17*c* about which the thatch elements 18 will be looped.

A different embodiment of the binder is shown in FIG. 8 and is designated generally by the reference numeral 50. The binder 50 is also of generally C-shaped configuration with a forwardly opening recess 54 which is bounded by inwardly projecting lips 54*a*. The binder 50 is provided with an inclined flange 51 having drain opening 52 therein. An attachment portion 53 is integral with flange 51 and will be attached by suitable fasteners 24 such as nails, staples, or other types of fasteners to the substrate. The binder 50 does not require a batten and will be provided with a center element 17*c* about which the thatch elements 18 will be looped. It will be appreciated that binders having other shapes may be provided. In the embodiments shown, the binders are formed of a metal, but other materials such as polymers may also be used.

Referring now to FIG. 9, a further embodiment of a binder designated as element 60 and thatch elements 18 is thereshown. The binder 60 is generally of C-shaped configuration and the thatch elements 18 are fused or welded to binder 60. The shingle 16 (binder 60 and thatch elements 18) will be secured to the substrate 13 or batten 21 by suitable fasteners 24. Elongate slots 61 may be provided on the binder 60 for accommodating staples. The slots 61 my extend longitudinally, transversely, or in any direction of the binder 60. An opening 62 for accommodating fasteners 24 may also be provided. Although, different shaped and positioned openings are depicted in the embodiment of FIG. 9, the different openings for accommodating different fasteners 24 are for illustrative purposes only. The shingles 16 will preferably have openings therein of only one shape and disposition.

From the foregoing, it will be seen that I have provided a novel roof and method of applying the same which simulates a natural thatch roof. The color of the thatch may be that of the natural thatch material or it may be formed of other colors. It will be appreciated that the simulated thatch roofing not only functions as a protective roofing, but also imparts a highly aesthetic quaint appearance.

What is claimed is:

1. A roofing material member simulating natural thatch material, the roofing material member comprising, a plurality of elongate similar thatch elements folded approximately 180 degrees to define a folded portion, disposed in a substantially parallel relation and arranged in a laterally extending bundle, the thatch elements having unbound free ends; and an elongate, generally C-shaped in cross-section, binder extending transversely of the thatch elements and secured to the folded portion of the thatch elements, the free ends of the thatch elements extending from the binder in the same direction, whereby when a plurality of roofing material members are secured to a roof in overlapping shingled relation, said roofing material members will simulate a natural thatched roof.

2. The roofing material member as defined in claim 1, wherein said roofing material member comprises an elongate roll, which when unrolled and applied to the roof is of generally rectangular shape.

3. The roofing material member as defined in claim 1 wherein said roofing material member comprises a rectangular shaped shingle.

4. The roofing material member as defined in claim 1 wherein said thatch elements are formed of polymer.

5. The roofing material member as defined in claim 1 wherein the free ends of the thatch elements present a sloping beveled edge portion.

6. The roofing material member as defined in claim 5 wherein the thatch elements are folded in an offset manner such that the free ends present the sloping beveled edge portion.

7. The roofing material member as defined in claim 1 further comprising a transversely extending central member disposed within the binder and the folded portion of the thatch elements.

8. The roofing material member as defined in claim 7 wherein the binder is secured to the thatch elements by a method chosen from the class of securing methods including gluing, heat sealing, sewing and metal binding.

9. The roofing material member as defined in claim 1 wherein the binder is secured to the thatch elements by a method chosen from the class of securing methods including gluing, heat sealing, sewing and metal binding.

10. The roofing material member as defined in claim 1 wherein the binder further comprises fastener apertures adapted to receive fasteners for securing the roofing material member to the roof.

11. A roofing material member simulating natural thatch material the roofing material member comprising, a plurality of elongate similar thatch elements folded approximately 180 degrees to define a folded portion, disposed in a substantially parallel relation and arranged in a laterally extending bundle, the thatch elements having unbound free ends; and an elongate binder extending transversely of the thatch elements and secured to the folded portion of the thatch elements, the free ends of the thatch elements extending from the binder in the same direction, whereby when a plurality of roofing material members are secured to a roof in overlapping shingled relation, said roofing material members will simulate a natural thatched roof; wherein the binder further comprises a depending flange and an attachment portion for attachment of the binder to the roof.

12. The roofing material member as defined in claim 11 wherein the depending flange further comprises drain openings.

13. The roofing material member as defined in claim 11, wherein said roofing material member comprises an elongate roll, which when unrolled and applied to the roof is of generally rectangular shape.

14. The roofing material member as defined in claim 11, wherein said roofing material member comprises a rectangular shaped shingle.

15. The roofing material member as defined in claim 11, wherein said thatch elements are formed of polymer.

16. The roofing material member as defined in claim 11 wherein the free ends of the thatch elements present a sloping beveled edge portion.

17. The roofing material member as defined in claim 11 further comprising a transversely extending central member disposed within the binder and the folded portion of the thatch elements.

18. The roofing material member as defined in claim 11 wherein the binder is secured to the thatch elements by a method chosen from the class of securing methods including gluing, heat sealing, sewing and metal binding.

* * * * *